US010844687B2

(12) United States Patent
Rodela et al.

(10) Patent No.: US 10,844,687 B2
(45) Date of Patent: Nov. 24, 2020

(54) WELLHEAD SEAL ENERGIZED BY FLUID PRESSURE

(71) Applicant: GE Oil & Gas Pressure Control LP, Houston, TX (US)

(72) Inventors: Alejandro Rodela, Houston, TX (US); Joseph Pallini, Houston, TX (US); Andrew Ingram, Houston, TX (US); Greg Dunn, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 45 days.

(21) Appl. No.: 16/378,097

(22) Filed: Apr. 8, 2019

(65) Prior Publication Data

US 2019/0309594 A1 Oct. 10, 2019

Related U.S. Application Data

(60) Provisional application No. 62/654,010, filed on Apr. 6, 2018.

(51) Int. Cl.

| | |
|---|---|
| ***E21B 33/03*** | (2006.01) |
| ***E21B 33/04*** | (2006.01) |
| ***E21B 33/128*** | (2006.01) |
| ***E21B 47/117*** | (2012.01) |

(52) U.S. Cl.

CPC ..... *E21B 33/128* (2013.01); *E21B 33/04* (2013.01); *E21B 47/117* (2020.05); *E21B 2200/01* (2020.05)

(58) Field of Classification Search

CPC ..... E21B 33/04; E21B 2200/01; E21B 33/03; F16J 15/0887

See application file for complete search history.

(56) References Cited

U.S. PATENT DOCUMENTS

| | | | | |
|---|---|---|---|---|
| 4,665,979 | A | 5/1987 | Boehm, Jr. | |
| 4,719,971 | A | 1/1988 | Owens | |
| 4,742,874 | A | 5/1988 | Gullion | |
| 4,751,965 | A * | 6/1988 | Cassity | E21B 33/04 166/182 |
| 5,067,734 | A | 11/1991 | Boehm, Jr. | |
| 5,285,853 | A | 2/1994 | Eckert | |
| 5,364,110 | A | 11/1994 | Streich | |

(Continued)

OTHER PUBLICATIONS

General Electric, "Drilling & Production Systems Surface Wellhead & Tree Technology Update," 2009, 33 pages.

(Continued)

*Primary Examiner* — Kipp C Wallace

(74) *Attorney, Agent, or Firm* — Hogan Lovells US LLP

(57) ABSTRACT

An annulus seal for sealing an interface between a wellhead housing and a casing hanger. The annulus seal includes a central body portion, a first seal leg extending from the central body portion in a first direction and a second seal leg extending from the central body portion in the first direction across from the first seal leg. The first seal leg sealingly engages the casing hanger, and the second seal leg sealingly engages the wellhead housing. At least one of the first seal leg or the second seal leg includes at least one of a first cavity at least partially extending into the respective seal leg from the first direction or a second cavity at least partially extending into the respective seal leg from the second direction.

20 Claims, 6 Drawing Sheets

(56) References Cited

U.S. PATENT DOCUMENTS

| | | | | |
|---|---|---|---|---|
| 5,685,369 | A | 11/1997 | Ellis et al. | |
| 5,735,344 | A | 4/1998 | Duncan | |
| 5,997,003 | A * | 12/1999 | Turner | F16J 15/0887 277/339 |
| 6,367,558 | B1 | 4/2002 | Borak, Jr. | |
| 7,740,080 | B2 | 6/2010 | Fenton | |
| 8,146,670 | B2 | 4/2012 | Ellis et al. | |
| 8,205,670 | B2 | 6/2012 | Nelson | |
| 2003/0080516 | A1 | 5/2003 | Zheng | |
| 2010/0116489 | A1 | 5/2010 | Nelson | |
| 2010/0300705 | A1 | 12/2010 | Nelson | |

OTHER PUBLICATIONS

International Search Report and Written Opinion dated Jun. 21, 2019 in corresponding PCT Application No. PCT/US19/026358.
International Search Report and Written Opinion dated Jun. 20, 2019 in corresponding PCT Application No. PCT/US19/026282.

* cited by examiner

WELLHEAD SEAL ENERGIZED BY FLUID PRESSURE

CROSS REFERENCE TO RELATED APPLICATIONS

This application claims priority to U.S. Provisional Application No. 62/654,010 filed Apr. 6, 2018 titled "PRESSURE ENERGIZED SEAL ACTUATOR RING," the disclosure of which is incorporated herein by reference in its entirety.

BACKGROUND OF THE INVENTION

Technical Field

This invention relates generally to oilfield equipment. More particularly, this invention relates to an annulus seal for sealing an interface between components in a well.

Background

Wellhead assemblies in a well bore typically include a wellhead housing and a casing hanger. The casing hanger is set within the wellhead housing and, along with its associated casing string, serves to separate fluid within the casing from fluid in the surrounding annulus. Each of these fluids may be at different pressures depending on conditions in the well. Due to the interfacing configuration of the wellhead housing and the casing hanger, an annulus is formed between the wellhead housing and the casing hanger. This annulus is sealed by an annulus seal positioned in the annulus. First, the annulus seal needs to be set in place. Known annulus seals are typically set into place from above. Specifically, the annulus seal is placed in the annulus and then an energizing ring is pushed into the annulus seal to cause the surfaces of the annulus seal to be urged onto both the wellhead housing and the casing hanger, thereby "energizing" the annulus seal. Ideally, the annulus seal remains constantly sealed against both the wellhead housing and the casing hanger. However, it typically requires a large force to energize and set the annulus seal, and there may be limitations to the amount of force that can be applied in some cases. This may prevent the annulus seal from being optimally energized, and thus decrease the pressure the annulus seal can withstand.

SUMMARY OF THE INVENTION

One embodiment of the present technology includes an annulus seal for sealing an interface between a wellhead housing and a casing hanger. The annulus seal includes a central body portion, a first seal leg extending from the central body portion in a first direction and a second seal leg extending from the central body portion in the first direction across from the first seal leg. The first seal leg sealingly engages the casing hanger, and the second seal leg sealingly engages the wellhead housing. At least one of the first seal leg or the second seal leg includes at least one of a first cavity at least partially extending into the respective seal leg from the first direction or a second cavity at least partially extending into the respective seal leg from the second direction.

Another embodiment of the present technology includes an annulus seal assembly for sealing the interface between a first wellhead tubular and a second wellhead tubular. The annulus seal assembly includes an annulus seal and an energizing ring. The annulus seal includes a central body portion, a first seal leg extending from the central body portion in a first direction, the first seal leg sealingly engaging the first wellhead tubular, and a second seal leg extending from the central body portion in the first direction across from the first seal leg, the second seal leg sealingly engaging the second wellhead tubular. In some embodiments, a third leg may extend from the central body portion in a second direction opposite the first direction. The energizing ring includes a nose end for insertion between the first seal leg and the second seal leg of the annulus seal from the first direction to energize the first and second seal legs of the annulus seal into a primary sealed engagement with the first wellhead tubular and the second wellhead tubular. At least one of the first seal leg or the second seal leg includes a cavity formed therein. The cavity is in fluid communication with an environment external to the annulus seal and expandable from pressure in the first environment. The expansion energizes the annulus seal into a secondary sealed engagement with the first wellhead tubular and the second wellhead tubular.

Yet another embodiment of the present technology is a method of energizing an annulus seal assembly between a wellhead housing and a casing hanger. The method includes inserting an annulus seal assembly between the wellhead housing and the casing hanger. The annulus seal assembly includes an annulus seal and an energizing ring, the annulus seal having two upwardly extending seal legs. The seal legs include cavities formed therein extending at least partially into the seal legs. The method further includes pushing the energizing ring downward to insert at least a portion of the energizing ring between the seal legs of the annulus seal, thereby pushing the seal legs away from each other and urging the seal legs against the wellhead housing and the casing hanger to form a seal therebetween. The method further includes expanding the cavities formed in the seal legs via pressurized fluid pushing on the annulus seal, and urging the seal legs against the wellhead housing and the casing hanger from expansion of the cavities.

BRIEF DESCRIPTION OF DRAWINGS

The accompanying drawings, which are incorporated in and constitute a part of the specification, illustrate one or more embodiments and, together with the description, explain these embodiments. In the drawings.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

An annulus seal is used to control the flow of drilling and production fluids in a subsea or surface wellhead. It isolates the annulus space between the casing hangers and the wellhead housing. The annulus seal is a basic component within most wellheads. However, the conventional process of setting and energizing an annulus seal requires a large force applied to set the annulus seal to generate a sufficient preload (i.e., radial force applied by the annulus seal onto the casing hangers and the wellhead housing to form a seal). As presented in greater detail below, present embodiments provide for an annulus seal that is capable of utilizing naturally occurring bore pressure and annulus pressure to expand the annulus seal and further energize the annulus seal, thereby providing for a securely set and energized annulus seal without requiring as large of a setting force or preload.

Figure 1:
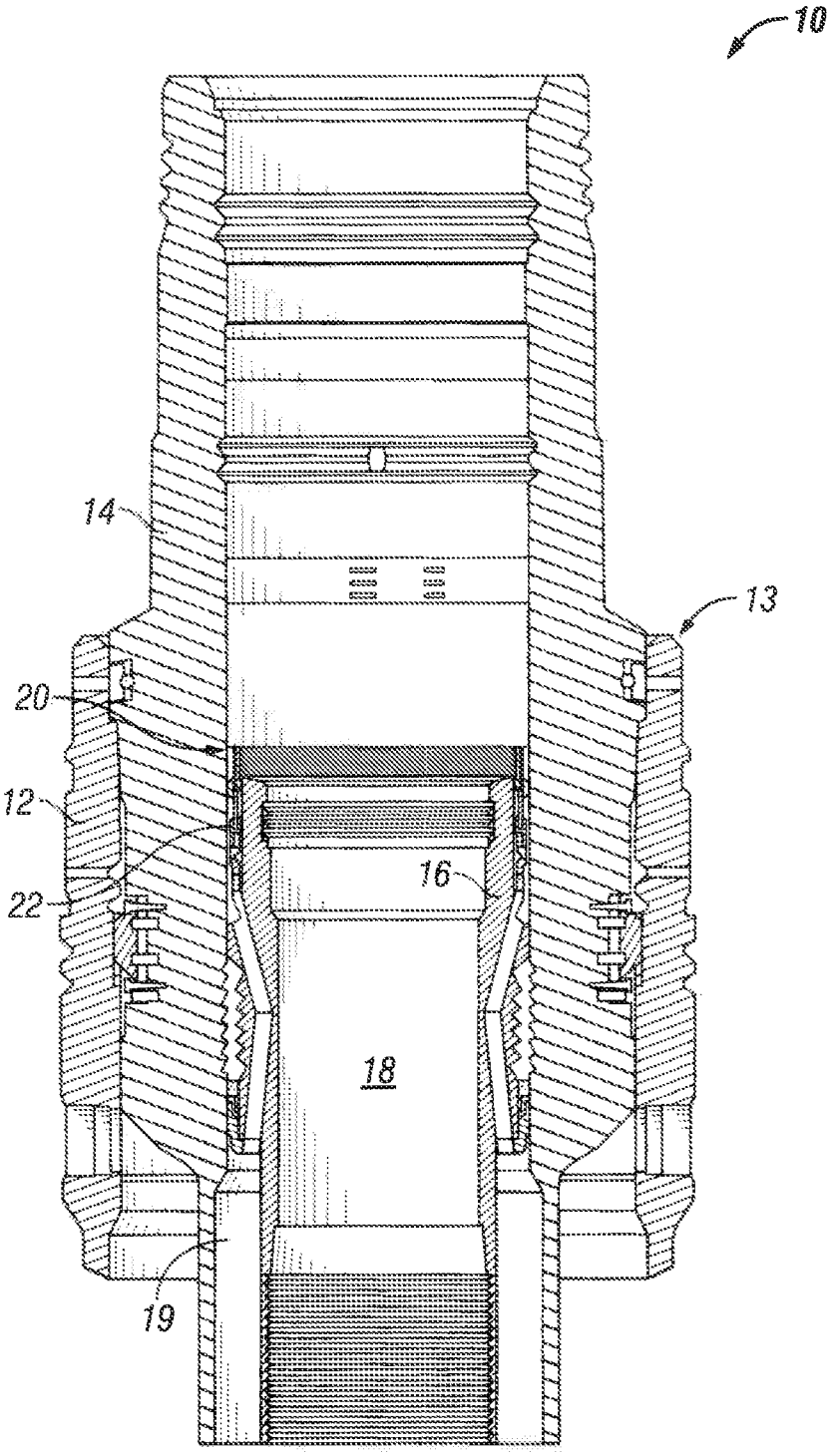
FIG. 1 illustrates a cross-sectional view of a wellhead assembly, in accordance with example embodiments.

FIG. 1 shows a wellhead assembly 10 as typically used in oil and gas drilling and production operations, and will serve to identify components of the system and establish the context in which the annulus seal of the present technology (described in greater detail below) will be used. The wellhead assembly 10 includes a conductor wellhead 12 configured to sit above the cavity of a well. Within the conductor wellhead 12 sits the wellhead housing 14, which is typically locked in place relative to the conductor wellhead 12. Within the wellhead housing 14, in turn, there can typically be positioned a casing hanger 16. From the casing hanger 16 is hung a casing string.

The casing hanger 16 and casing string surround a bore 18. During drilling operations, drilling pipe and tools pass through the casing hanger 16 via the bore 18 toward the bottom of the well. Similarly, during production operations, production piping and tools pass through the casing hanger 16 via the bore 18. The bore 18 contains drilling fluid, or mud, that is designed to control pressure in the well, and carry chips and debris away from the drill bit during drilling operations. The mud within the bore 18 is maintained at an appropriate bore pressure, which varies according to conditions in the well. The area outside the casing hanger 16 and casing string is an annulus 19 which can also contain fluid, such as fluid entering the annulus from the formation through which the bore hole 13 is drilled. The fluid within the annulus has an annular pressure that may be different from the bore pressure within the casing hanger 16, which results in an unbalance force.

An annulus seal assembly 20, including annulus seal 22, is provided between the wellhead housing 14 and the casing hanger 16 to seal the interface therebetween. In order to set, or "energize" the annulus seal 22 into a sealing position, an energizing ring is pushed into the annulus seal 22 to cause the annulus seal to expand outward and to be urged onto both the wellhead housing and the casing hanger, thereby sealing the annulus 19.

It typically requires a large force to energize and set the annulus seal 22. However, there may be limitations to the amount of setting force that can be applied. This may prevent the annulus seal from being optimally energized, and thus decrease the pressure the annulus seal 22 can withstand. As mentioned, the seal 22 may be exposed to a downward bore pressure from above the annulus seal 22 and/or an upward annular pressure from below the annulus seal 22. If the annulus seal 22 is not sufficiently energized, it may be susceptible to these pressures and/or other disturbances that may occur. For example, the annulus seal 22 may leak, become weakened, and even pushed out of the pocket. The annulus seal of the present technology solves this problem by providing for an annulus seal that is capable of utilizing naturally occurring bore pressure and annulus pressure to further energize the annulus seal, thereby providing for a securely set and energized annulus seal without requiring a large initial setting force, as shown in FIGS. 2-9 and explained in detail below.

Figure 2:
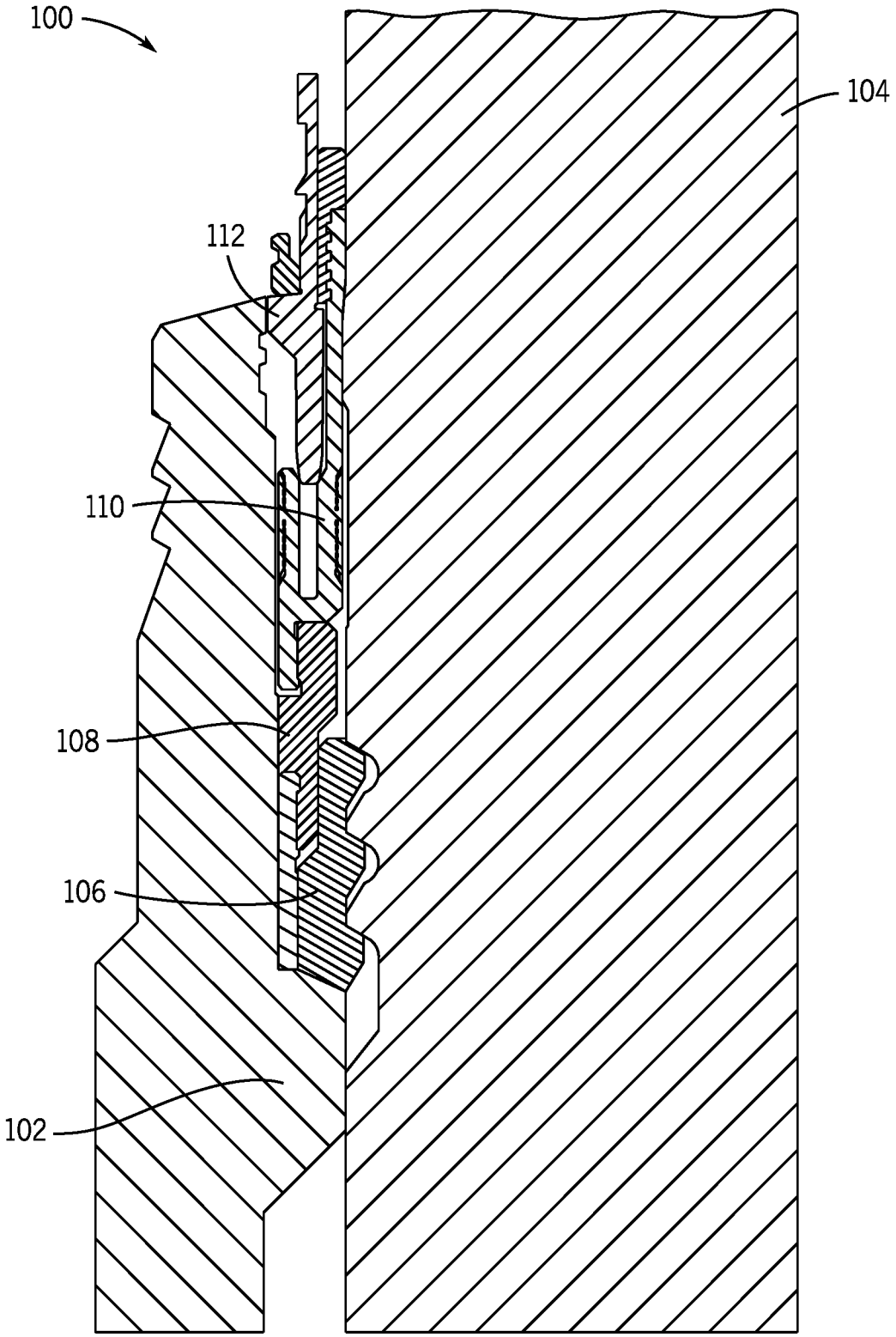
FIG. 2 illustrates a cross-sectional view of an annulus seal assembly, in accordance with example embodiments.

FIG. 2 illustrates a view of an annulus seal assembly, in accordance with example embodiments. Referring now to FIG. 2, there is shown a seal assembly 100 in an unenergized state according to an embodiment of the present technology. The seal assembly 100 is positioned between a casing hanger 102 and a wellhead housing 104. The seal assembly 100 includes a load ring 106, a landing ring 108, an annulus seal 110, and a seal energizing ring 112. In some embodiments, the seal assembly 100 may be designed to be pre-assembled and inserted into an annular space between the casing hanger 102 and the wellhead housing 104 as a unified assembly.

Figure 4:
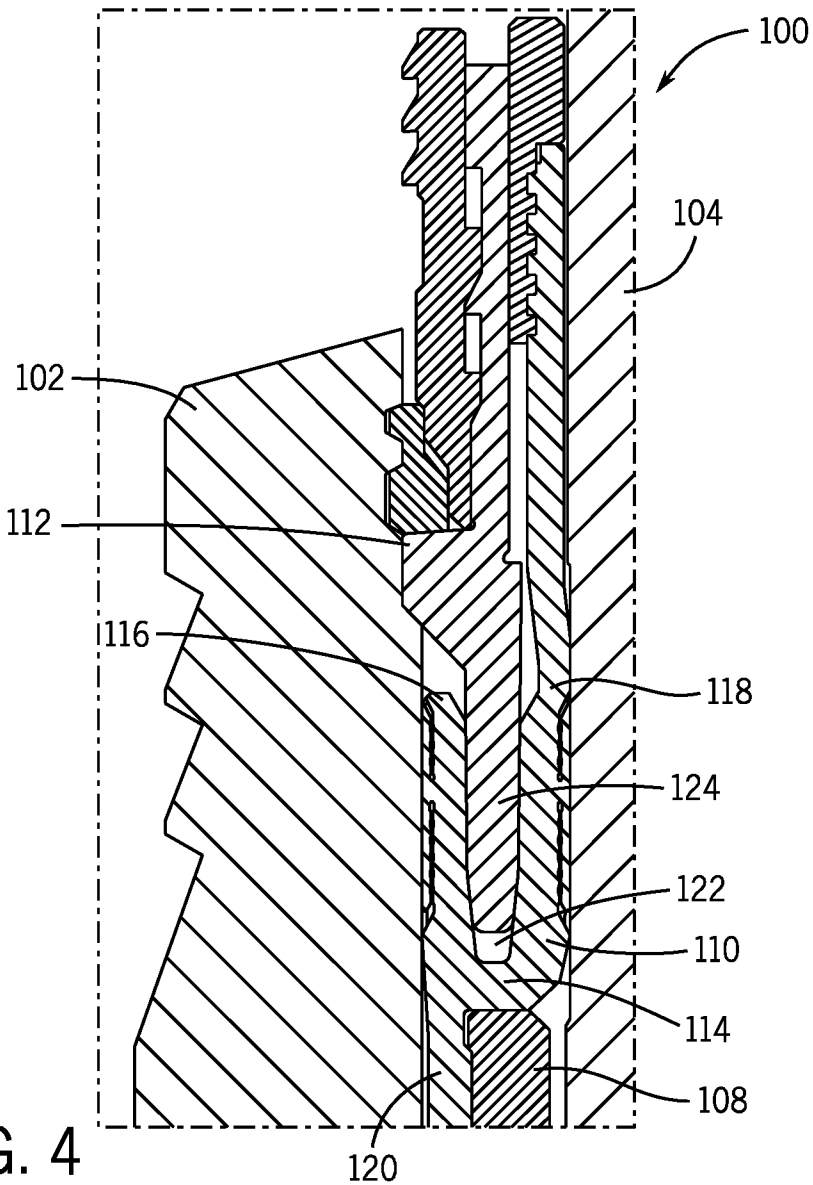
FIG. 4 illustrates a cross-sectional view of the annulus seal assembly in an energized state, zoomed in on the energizing ring and the annulus seal, in accordance with example embodiments.
Figure 3:
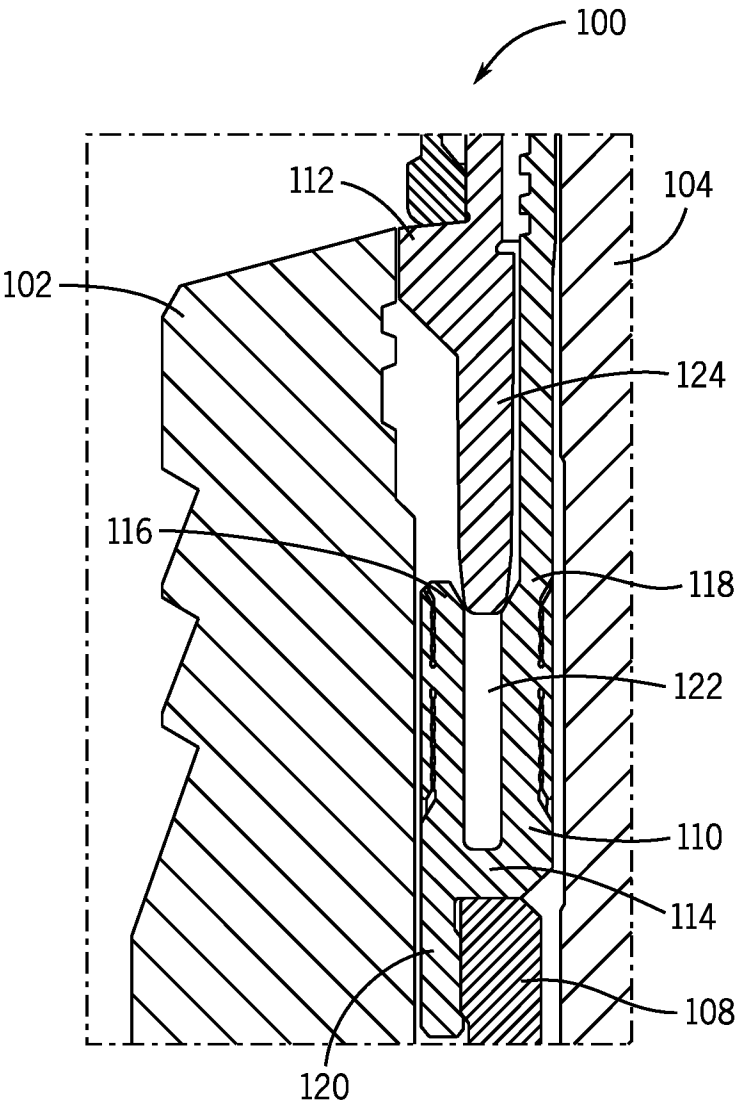
FIG. 3 illustrates a cross-sectional view of the annulus seal assembly in an unenergized state, zoomed in on the energizing ring and the annulus seal, in accordance with example embodiments.

FIG. 3 illustrates a larger view of the annulus seal assembly 100 in an unenergized state, zoomed in on the energizing ring 112 and the annulus seal 110, in accordance with example embodiments. FIG. 4 illustrates the same, but with the annulus seal assembly 100 in the energized state, in accordance with example embodiments. Referring to FIGS. 2, 3, and 4, the annulus seal 110 includes a central body portion 114, and a first seal leg 116 and a second seal leg 118 that extend upwardly toward the top of the well. The first seal leg 116, central body portion 114, and the second seal leg 118 create a U-shape, with a space 122 between the first seal leg 116 and second seal leg 118 for accepting the energizing ring 112. In some embodiments, the second seal leg 118 extends upward a greater distance than the first seal leg 116. In some embodiments, the second seal leg 118 can have threads that correspond to threads another component in the seal assembly 100. In the unenergized state, such as that shown in FIG. 3, the distance between the first seal leg 116 and second seal leg 118 is less than the thickness of the nose end 124 of the energizing ring 112. In addition, the lower ends of the nose end 124 of the energizing 112 can be angled to ease ingress into the space 122 between the first seal leg 116 and second seal leg 118. In some embodiments, the annulus seal 110 also includes a third leg 120 extending from the central body portion 114 in a second direction opposite the first direction. In some embodiments, the third leg 120 may latch onto the landing ring 108 and/or sealingly engage one of the wellhead housing or the casing hanger, further maintaining the position of the annulus seal 110. In some embodiments, the annulus seal 110 may be made of metal, so that the seal between the annulus seal 110 and the well components is a metal-to-metal seal.

The energizing ring 112 includes a nose end 124 for insertion between the first seal leg 116 and the second seal leg 118 of the annulus seal 110 from the first direction to energize the seal legs 116, 118 into sealed engagement with the wellhead housing 104 and the casing hanger 102 when the annulus seal 110 and the energizing ring 112 are compressed together. The energizing ring 112 is positioned above the annulus seal 110 and when the annulus seal is unenergized, the nose end 124 abuts the space 122 between the seal legs 116, 118. In some embodiments, during pre-assembly of the seal assembly 100, the energizing ring 112 can be positioned above the annulus seal 110. In some embodiments, the energizing ring 112 may be secured using a securement mechanism to restricting axial movement of the energizing ring 112 relative to the annulus seal 110 as the seal assembly 100 is positioned in the wellhead assembly 10 (FIG. 1).

After the seal assembly 100 is inserted into the wellhead assembly 10 (FIG. 1) between the wellhead housing 104 and the casing hanger 102, a setting tool (not shown, but known to a person of ordinary skill in the art) exerts a downward force on the energizing ring 112. The energizing ring 112 in turn exerts a downward force on the annulus seal 110 which transmits the downward force to the landing ring 108 and load ring 106. As a result, the entire seal assembly 120 moves downward into the annulus relative to the casing hanger 102 and the wellhead housing 104.

The setting tool continues to exert a downward force on the energizing ring 112 until the nose end 124 of the energizing ring 112 penetrates the space 122 between the first seal leg 116 and the second seal leg 118. In some embodiments, such ingress is facilitated by the angled lower ends of the nose end 124 of the energizing ring 112 that help guide the nose end 124 of the energizing ring 112 into the space 122. Because the width of the nose end 124 is greater than the width of the space 122 between the first seal leg 116 and the second seal leg 118, ingress of the nose end 124 into the space 122 forces the first seal leg 116 and the second seal leg 118 outwardly into sealed engagement with the casing hanger 102 and the wellhead housing 104. As described, the energizing ring 112 provides an initial energizing force for sealing the annulus seal 110 against the wellhead housing 104 and/or the casing hanger 102.

Once seated and energized, the annulus seal 110 is typically acted on by various forces. The annulus seal 110 is exposed on an upper end to bore pressure, which applies a pressure force in a downward direction against the annulus seal 110. Similarly, the annulus seal 110 is exposed on a lower end to annular pressure, which applies a pressure force in an upward direction against the annulus seal 110. As discussed in detail below, the presently disclosed annulus seal utilizes these forces to further energize and the seal maintain the annulus seal 110 in an energized state.

Figure 6:
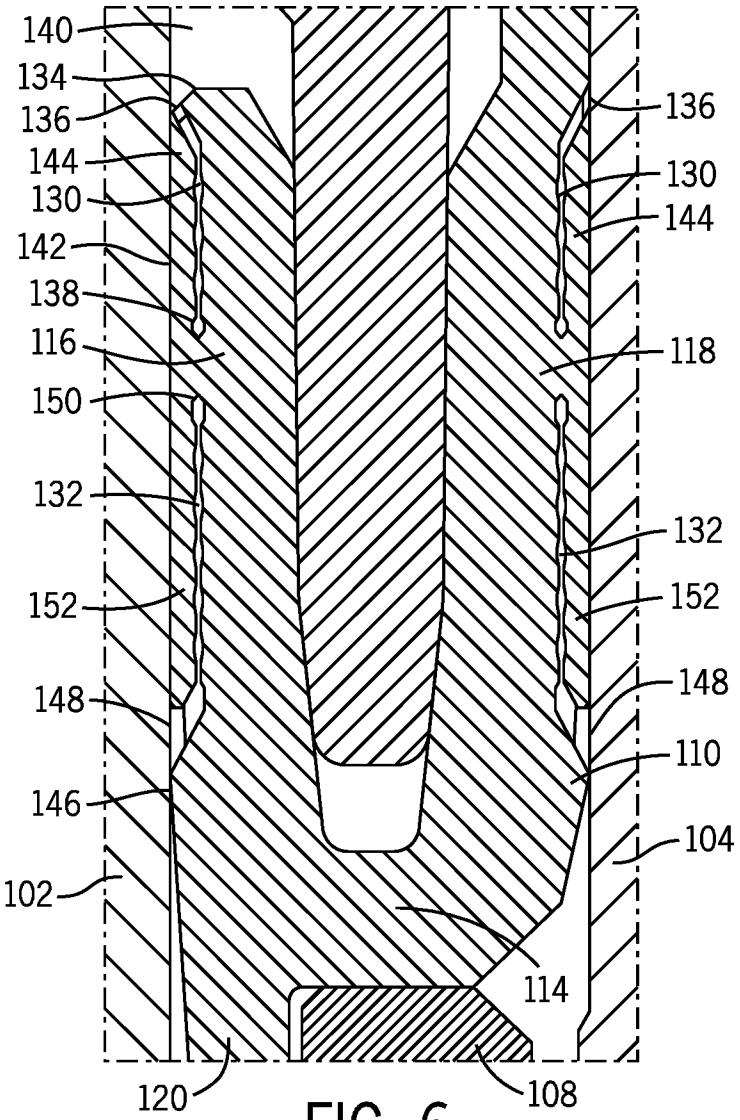
FIG. 6 illustrates a first cross-sectional view of the annulus seal in an energized state, in accordance with example embodiments.
Figure 5:
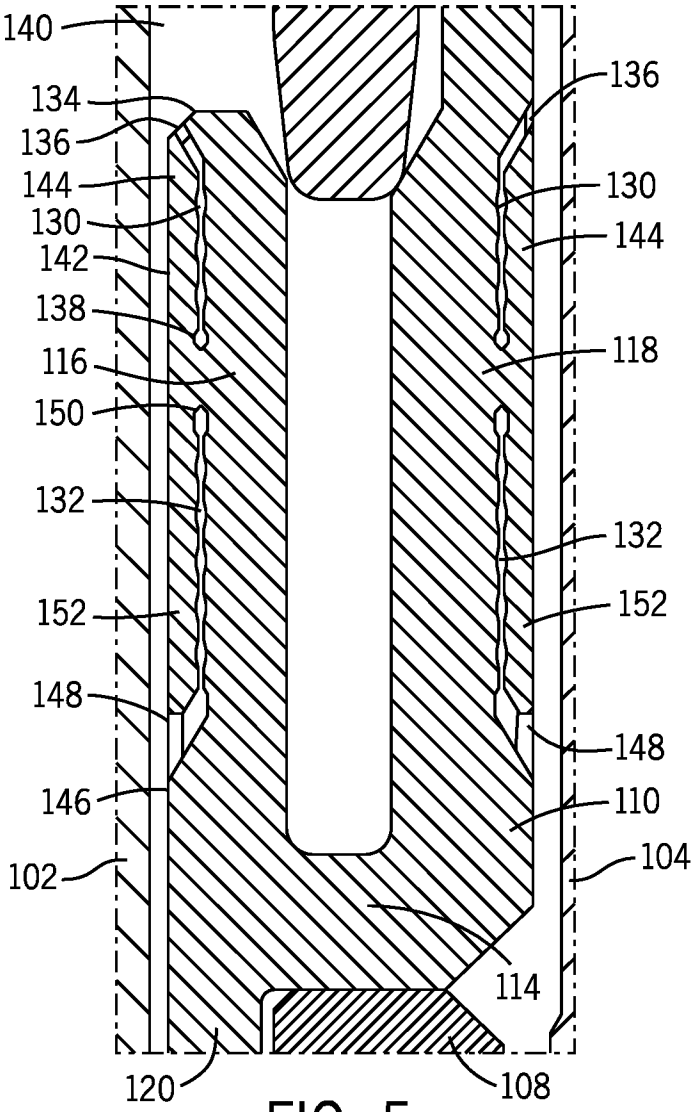
FIG. 5 illustrates a first cross-sectional view of the annulus seal in an unenergized state, in accordance with example embodiments.

FIG. 5 illustrates a larger view of the annulus seal 110 in an unenergized state, in accordance with example embodiments. FIG. 6 illustrates the same, but with the annulus seal 110 an energized state, in accordance with example embodiments. Referring to FIGS. 5 and 6, the first seal leg 116 of the annulus seal 110 has a first cavity 130 formed therein and a second cavity 132 formed therein. In some embodiments, such as the illustrated embodiments, the first cavity 130 extends into the first seal leg 116 from a tip or edge portion 134 of the first seal leg 116, and extends further into the first seal leg 116 in a downward direction. In other words, a fluid communication port 136 of the first cavity 130 is higher (e.g., further uphole, further away from the seal body portion) than the end 138 of the first cavity 130. The first cavity 130 is in fluid communication with an annular space 140 on a first side of (e.g., above) the annulus seal 110. Thus, after the annulus seal 110 is initially energized by the energizing ring, fluid pressure in the space 140 pushing on the annulus seal 110 in the downward direction causes the first cavity 130 to fill with the pressurized fluid and expand, which effectively causes the first seal leg 116 to expand and thereby further energize the annulus seal 110. In some embodiments, the first cavity 130 is formed near an outer wall 142 of the first seal leg 116, such that a membrane 144 is formed from the first seal leg 116 between the outer wall 142 and the first cavity 130. When the first cavity 130 expands due to the pressure, the membrane 144 is flexed outward and further urged onto the casing hanger 102. In some embodiments, the first cavity 130 may be generally ring-shaped and formed circumferentially through the first seal leg. In some embodiments, there are a plurality of fluid communication ports 136 formed in the first seal leg (e.g., circumferentially arranged) to provide multiple paths for fluid to communicate into and out of the first cavity 130 from the first direction.

The second cavity 132 extends into the first seal leg 116 from an edge portion 146 of the first seal leg 116 and extends further into the first seal leg 116 in an upward direction. In other words, a fluid communication port 148 of the second cavity 132 is lower (e.g., further downhole, closer to the seal body portion) than the end 150 of the cavity. The second cavity 132 is in fluid communication with the annular space on a second side of (e.g., below) the annulus seal 110. Thus, after the annulus seal 110 is initially energized by the energizing ring, fluid pressure pushing on the annulus seal 110 in an upward direction (i.e., from below the seal) causes the second cavity 132 to expand, which effectively causes the first seal leg 116 to expand and thereby further energize the annulus seal 116. In some embodiments, the second cavity 132 is formed near the outer wall 142 of the first seal leg 116, such a second membrane 152 is formed between the outer wall 142 and the second cavity 132. When the second cavity 132 expands due to the pressure, the second membrane 152 is flexed outward and further urged onto the casing hanger 102. As illustrated, the first and second cavities 130, 132 are formed in opposite directions, such that pressure from below the annulus seal 110 that is pushing upward as well as pressure from above the annulus seal 110 that is pushing downward can both be utilized to further energize the annulus seal via expansion of the respective cavity 130, 132. In some embodiments, the second cavity 132 may be generally ring-shaped and formed circumferentially through the first seal leg. In some embodiments, there are a plurality of fluid communication ports 148 formed in the first seal leg (e.g., circumferentially arranged) to provide multiple paths for fluid to communicate into and out of the second cavity 132 from the second direction.

The second seal leg 118 may also have a first cavity 130 and a second cavity 132 formed therein similar to that described with respect to the first seal leg 116, as well as membranes 144 and 152 form therefrom. Thus, downward pressure pushing on the annulus seal may cause the first cavities 130 of both the first seal leg 116 and the second seal leg 118 to expand and push the respective membranes 144 of the first seal leg 116 and second seal leg 118 to further seal against the casing hanger 102 and the wellhead housing 104. Similarly, upward pressure pushing up on the annulus seal 110 may cause the second cavities 132 of both the first seal leg 116 and the second seal leg 118 to expand and push the respective membranes 152 of the first seal leg 116 and second seal leg 118 to further seal against the casing hanger 102 and the wellhead housing 104. Specifically, pressure is able to get behind the membranes 144, 152 and increase the contact force on the seal profile, thereby utilizing naturally occur well pressure to improve the seal performance. In the illustrated embodiments, each of the first and second seal legs 116, 118 has both a downward cavity 130 and an upward cavity 132, for a total of four cavities. In some embodiments, there may be fewer cavities. For example, in some embodiments, there may only be first cavities 130 or only second cavities 132. In some embodiments, only one of the two seal legs may have a cavity. In some embodiments, the third seal leg 120 may have a first cavity 130, a second cavity 132, or both, formed therein.

In particular, some embodiments may only include upward cavities 132, which utilize upward pressure from below the annulus seal 110 to further energize and strengthen the annulus seal 110. In conventional systems, since the annulus seal 110 is placed into position downwardly and energized by a downward force applied by the setting tool, it may be more susceptible to upwardly directed annular pressure. An increase in annular pressure below a conventional annulus seal tends to weaken the seal and can even push the seal out of the pocket. For example, in many known systems, when the bore pressure is lower than the annular pressure, the net force acting on a convectional annulus seal tends to push the annulus seal upward and can break the sealed engagement of the annulus seal with the wellhead housing 104 and/or the casing hanger 102, thereby compromising the integrity of the seal. Annular pressure may also cause the casing hanger 102 to deflect inward (i.e., compress to a smaller diameter). This deflection may cause the surface of the casing hanger 102 to move away from the annulus seal 110, which reduces the preload or energization of the annulus seal. The present embodiments provides a solution to this problem by utilizing the upward annular pressure in the upward cavity 132 and employing the pressure outwardly to further expand and energize the annulus seal 110, rather than allowing the pressure to solely act upwardly on the seal, which may work to weaken the seal. By using annular pressure to expand the annulus seal 110, in addition to the initial energizing force or preload caused by the energizing ring, the contact between the annulus seal and casing hanger can be more robustly maintained.

In some embodiments, the first and second cavities 130, 132 may be formed offset from each other such that the cavities 130, 132 can extend further in their respective directions and past each other (i.e., overlap), without intersecting. For example, the first cavity 130 may be positioned at a first radial position (e.g., closer to an outer radius of the first seal leg 116) and extend greater than 50% of the way down into the first seal leg 116. The second cavity 132 may be positioned at a second radial position (e.g., closer to an inner radius of the first seal leg 116) and extend greater than 50% of the way up the first seal leg 116.

Figure 8:
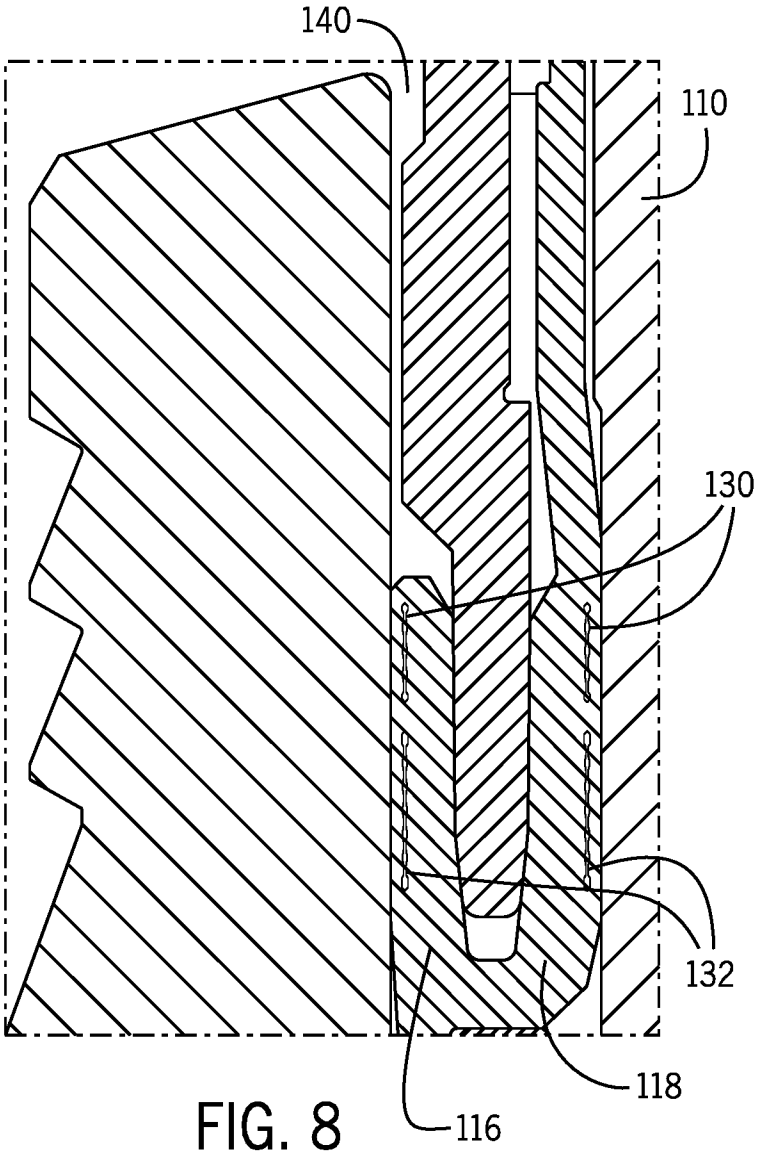
FIG. 8 illustrates a second cross-sectional view of the annulus seal in an energized state, in accordance with example embodiments.
Figure 7:
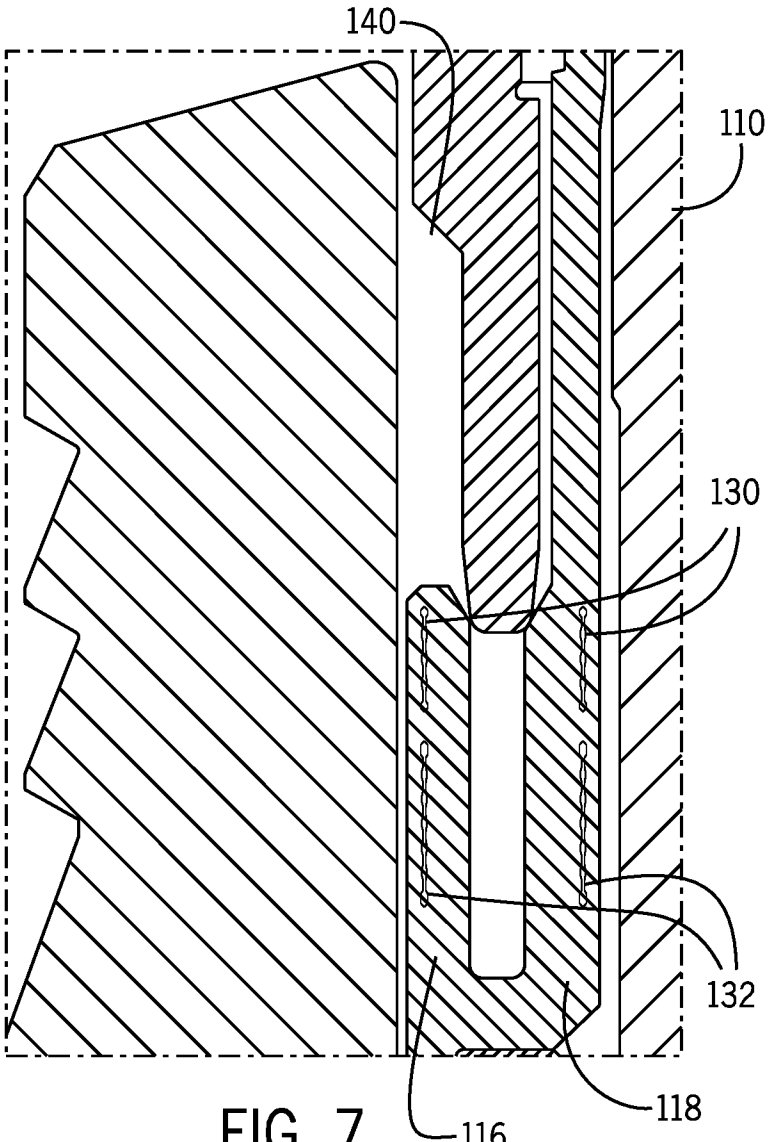
FIG. 7 illustrates a second cross-sectional view of the annulus seal in an unenergized state, in accordance with example embodiments.

FIG. 7 and FIG. 8 illustrate the annulus seal 110 in an unenergized and energized stated, respectively, at a view taken at a second cross-section, in accordance with example embodiments. The cross-section of FIGS. 7 and 8 are taken at a different circumferential position than FIGS. 5 and 6. Hence, the view of FIGS. 7 and 8 do not show the fluid communication port 136 and 148 shown in FIGS. 5 and 6. However, cavities 130 and 132 are visible in the FIGS. 7 and 8. In some embodiments, the first cavity 130 may be generally ring-shaped and formed circumferentially through the first seal leg 116 or the second seal leg 118 (or both) of the annulus seal 110, and is thus visible at a cross-section taken at any circumferential position. The one or more fluid communication ports, such as fluid communication port 136 (FIGS. 5 and 6) couple the first cavity 130 to the annular space 140 on a first side of (e.g., above) the annulus seal 110. Similarly, in some embodiments, the second cavity 132 may be also be generally ring-shaped and formed circumferentially through the first seal leg 116 or the second seal leg 118 (or both) of the annulus seal 110, and is thus visible at a cross-section taken at any circumferential position. One or more fluid communication ports, such as fluid communication port 148 (FIGS. 5 and 6) couple the second cavity 132 to the annular space 140 on a second side of (e.g., below) the annulus seal 110.

Figure 9:
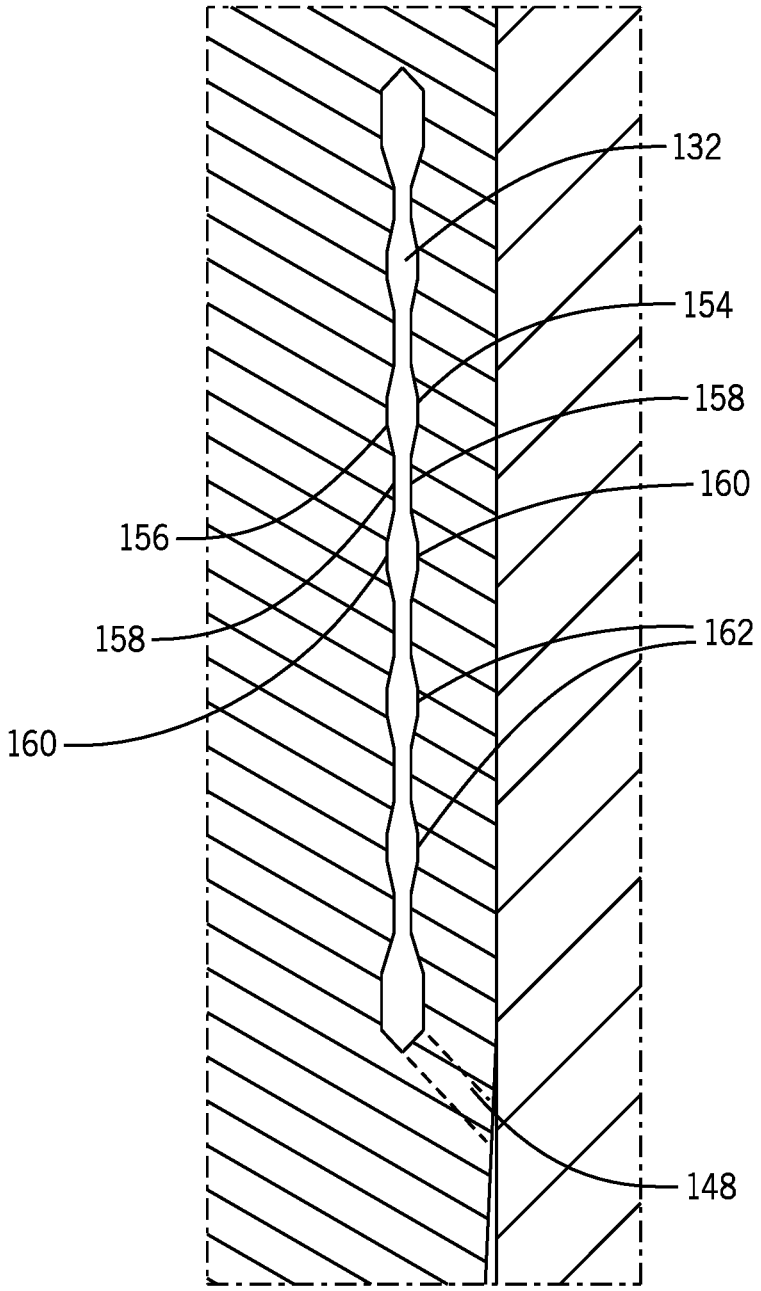
FIG. 9 illustrates a detailed cross-sectional view of a cavity of the annulus seal, in accordance with example embodiments.

Furthermore, the cavities 130, 132 formed in the seal legs 116, 118 may have various different shapes and configurations, according to different embodiments. FIG. 9 illustrates a detailed view of an example cavity configuration, in accordance with an example embodiment. In the illustrated embodiment of FIG. 9, the cavity 132 is narrow and elongated, and essentially defined by two walls 154 and 156. As illustrated, in some embodiments, the two walls 154, 156 have symmetrically wavy profiles with alternating crests 158 and grooves 160 such that the crests 158 of the two walls 154, 156 are aligned and face each other, effectively dividing the cavity 132 into a series of nodes 162 formed by the groove portions 160. In some embodiments, the nodes 162 are in fluid communication with each other so that pressure can communicate through all of the nodes 162. Such a configuration provides a flexible resistance which facilitates expansion of the cavity 132 in the presence of pressure. The possible profile configurations of the cavity 132 are many, and may be different than the illustrated example. For example, the profile of the cavity 132 may be straight or curved with fewer undulations. The profile of the cavity 132 may be teeth shaped rather than wave shaped. The cavity 132 may have one or more fluid communication ports 148 coupling the second cavity 132 to the annular space 140 to an environment outside of the annulus seal.

It should be noted that the present description uses a wellhead housing 104 and a casing hanger 102 as examples of two wellhead tubulars that may be coupled to otherwise arranged relative to one another, creating an annulus. However, other equipment at least partially having a tubular shape may also be arranged in a way such that an annulus is created between them. For example, a tubing hanger is another type of wellhead tubular that can be used with embodiments of the present disclosure. The annulus seal of the present disclosure may be utilized to seal any such annulus between any two tubulars, and is not limited to being used with wellhead housings and casing hangers.

In accordance with example embodiments, and with reference to FIGS. 3 and 4, a method of energizing an annulus seal 110 assembly between a wellhead housing 104 and a casing hanger 102 includes inserting an annulus seal assembly 100 between the wellhead housing 104 and the casing hanger 102. The annulus seal assembly 100 including an annulus seal 110 and an energizing ring 112. The annulus seal 110 includes two upwardly extending seal legs 116, 118 which include cavities 130, 132 formed therein extending at least partially upwardly into the seal legs 116, 118. The method further includes pushing the energizing ring 112 downward to insert at least portion of the energizing ring 112 between the seal legs 116, 118 of the annulus seal 110, thereby pushing the seal legs 116, 118 away from each other and urging the seal legs 116, 118 against the wellhead housing 104 and the casing hanger 102 to form a seal therebetween. In some embodiments, the energizing ring 112 may be pushed downward by a setting tool. The method further includes expanding the cavities 130, 132 formed in the seal legs 116, 118 via pressurized fluid pushing on the annulus seal 110, and urging the seal legs 116, 118 against the wellhead housing 104 and the casing hanger 102 from expansion of the cavities 130, 132.

In some embodiments, the cavities 130, 132 are in fluid communication with an annulus between the wellhead housing 104 and the casing hanger 102 and pressure in the annulus causes the cavities 130, 132 to expand and further energize the annulus seal 110. In some embodiments, the annulus seal 110 further includes additional cavities formed therein extending at least partially downwardly into the seal legs 116, 118. In some embodiments, the method further includes expanding the additional cavities 116, 118 formed in the seal legs via pressurized fluid pushing downwardly on the annulus seal 110.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. An annulus seal for sealing an interface between a wellhead housing and a casing hanger, the annulus seal comprising:

a central body portion;

a first seal leg extending from the central body portion in a first direction, the first seal leg sealingly engaging the casing hanger; and a second seal leg extending from the central body portion in the first direction across from the first seal leg, the second seal leg sealingly engaging the wellhead housing;

wherein at least one of the first seal leg or the second seal leg includes at least one of a first cavity at least partially extending into the respective seal leg from the first direction or a second cavity at least partially extending into the respective seal leg from a second direction, wherein fluid pressure pushing on the annulus seal from the first direction causes the first cavity to expand and urge at least one wall of the annulus seal onto the wellhead housing or case hanger.

2. The annulus seal of claim 1, wherein each of the first seal leg and the second seal leg includes a respective first cavity and a respective second cavity formed therein.

3. The annulus seal of claim 1, wherein at least one of the first cavity or the second cavity is elongated and at least partially defined by two walls.

4. The annulus seal of claim 3, wherein the two walls have wavy profiles with alternating crests and grooves.

5. The annulus seal of claim 1, wherein fluid pressure pushing on the annulus seal from the first direction causes the first cavity to expand and urge at least one wall of the annulus seal onto the wellhead housing or case hanger.

6. The annulus seal of claim 1, wherein fluid pressure pushing on the annulus seal from the second direction causes the second cavity to expand and urge at least one wall of the annulus seal onto the wellhead housing or case hanger.

7. The annulus seal of claim 2, wherein the first cavity and the second cavity are positioned at different radial positions and extend past each other without intersecting.

8. An annulus seal assembly for sealing the interface between a first wellhead tubular and a second wellhead tubular, the annulus seal assembly comprising:

an annulus seal comprising:

a central body portion;

a first seal leg extending from the central body portion in a first direction, the first seal leg sealingly engaging the first wellhead tubular; and a second seal leg extending from the central body portion in the first direction across from the first seal leg, the first seal leg sealingly engaging the second wellhead tubular; and an energizing ring having a nose end for insertion between the first seal leg and the second seal leg of the annulus seal from the first direction to energize the first and second seal legs of the annulus seal into a primary sealed engagement with the first wellhead tubular and the second wellhead tubular, wherein at least one of the first seal leg or the second seal leg includes a cavity formed therein, the cavity at least partially extending into the respective seal leg from the first direction or at least partially extending into the respective seal leg from a second direction which is opposite the first direction, the cavity in fluid communication with an environment external to the annulus seal and expandable from pressure in the first environment, the expansion energizing the annulus seal into a secondary sealed engagement with the first wellhead tubular and the second wellhead tubular.

9. The annulus seal assembly of claim 8, wherein the cavity is a first cavity and first seal leg or second seal leg includes a second cavity, wherein the first cavity is in fluid communication with annular space on a first side of the annulus seal, and the second cavity is in fluid communication with annular space on a second side of the annulus seal.

10. The annulus seal assembly of claim 9, wherein fluid pressure from the first side of the annulus seal causes the first cavity to expand and push the respective leg in which the first cavity is formed against at least one of the first wellhead tubular or second wellhead tubular.

11. The annulus seal assembly of claim 9, wherein fluid pressure from the second side of the annulus seal causes the second cavity to expand and push the respective leg in which the second cavity is formed against at least one of the first wellhead tubular or second wellhead tubular.

12. The annulus seal assembly of claim 9, wherein each of the first seal leg and the second seal leg includes a respective first cavity and a respective second cavity formed therein.

13. The annulus seal assembly of claim 8, wherein the cavity is elongated and at least partially defined by two walls having wavy profiles with alternating crests and grooves.

14. The annulus seal assembly of claim 13, wherein the crests and grooves of the two walls are symmetrically arranged, forming a plurality of nodes in fluid communication with each other.

15. The annulus seal assembly of claim 8, further comprising a third leg extending in a second direction opposite the first direction.

16. The annulus seal assembly of claim 15, wherein the third leg includes a second cavity formed therein, the second cavity in fluid communication with the environment and expandable from pressure in the environment.

17. A method of energizing an annulus seal assembly between a wellhead housing and a casing hanger, the method comprising:

inserting an annulus seal assembly between the wellhead housing and the casing hanger, the annulus seal assembly including an annulus seal and an energizing ring, the annulus seal comprising two upwardly extending seal legs, wherein the seal legs include cavities formed therein extending at least partially upwardly or downwardly into the seal legs;

pushing the energizing ring downward to insert at least portion of the energizing ring between the seal legs of the annulus seal, thereby pushing the seal legs away from each other;

urging the seal legs against the wellhead housing and the casing hanger to form a seal therebetween via the energizing ring;

expanding the cavities formed in the seal legs via pressurized fluid pushing on the annulus seal; and urging the seal legs against the wellhead housing and the casing hanger from expansion of the cavities.

18. The method of claim 17, wherein the cavities extend upwardly into the seal legs and expand due to pressure from below the annulus seal.

19. The method of claim 18, wherein the annulus seal further comprises additional cavities formed therein extending at least partially downwardly into the seal legs.

20. The method of claim 19, further comprising:

expanding the additional cavities formed in the seal legs via pressurized fluid pushing downwardly on the annulus seal.

* * * * *